US010656569B2

(12) United States Patent
Watanabe et al.

(10) Patent No.: US 10,656,569 B2
(45) Date of Patent: May 19, 2020

(54) CONTROL ELECTRODE FOR IMAGE FORMATION APPARATUS

(71) Applicant: Konica Minolta, Inc., Chiyoda-ku, Tokyo (JP)

(72) Inventors: Makiko Watanabe, Uji (JP); Eiji Tabata, Ibaraki (JP); Nofumi Mizumoto, Nara (JP); Toshiya Natsuhara, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/391,166

(22) Filed: Apr. 22, 2019

(65) Prior Publication Data

US 2019/0346793 A1 Nov. 14, 2019

(30) Foreign Application Priority Data

May 8, 2018 (JP) ..... 2018-090164

(51) Int. Cl.
*G03G 15/16* (2006.01)

(52) U.S. Cl.
CPC ..... *G03G 15/1665* (2013.01)

(58) Field of Classification Search
CPC ..... G03G 15/1665
See application file for complete search history.

(56) References Cited

U.S. PATENT DOCUMENTS 4,931,839 A * 6/1990 Tompkins ..... G03G 15/0131 399/101
5,053,827 A * 10/1991 Tompkins ..... G03G 15/161 355/77
2013/0094870 A1* 4/2013 Shimizu ..... G03G 15/1605 399/45
2017/0205754 A1* 7/2017 Tabata ..... G03G 15/1605

FOREIGN PATENT DOCUMENTS

JP 2000-305381 A 2/2000

OTHER PUBLICATIONS

Machine translation of JP-2000305381 (Year: 2000).*

* cited by examiner

*Primary Examiner* — G. M. A Hyder
(74) *Attorney, Agent, or Firm* — Squire Patton Boggs (US) LLP

(57) ABSTRACT

Prevention of an image defect due to discharging in a transfer portion and ensured transfer efficiency are both achieved. A control electrode is in contact with an outer circumferential surface of a secondary transfer roller on an upstream side of a position of contact between the secondary transfer roller and a recording medium in a direction of rotation of the secondary transfer roller. The control electrode has a potential set to a repel a toner image with respect to the secondary transfer roller. The control electrode is in contact with the outer circumferential surface of the secondary transfer roller under such a condition that discharging occurs in a gap between the secondary transfer roller and the intermediate transfer belt and a discharging current flows through the recording medium.

3 Claims, 9 Drawing Sheets

FIG.10

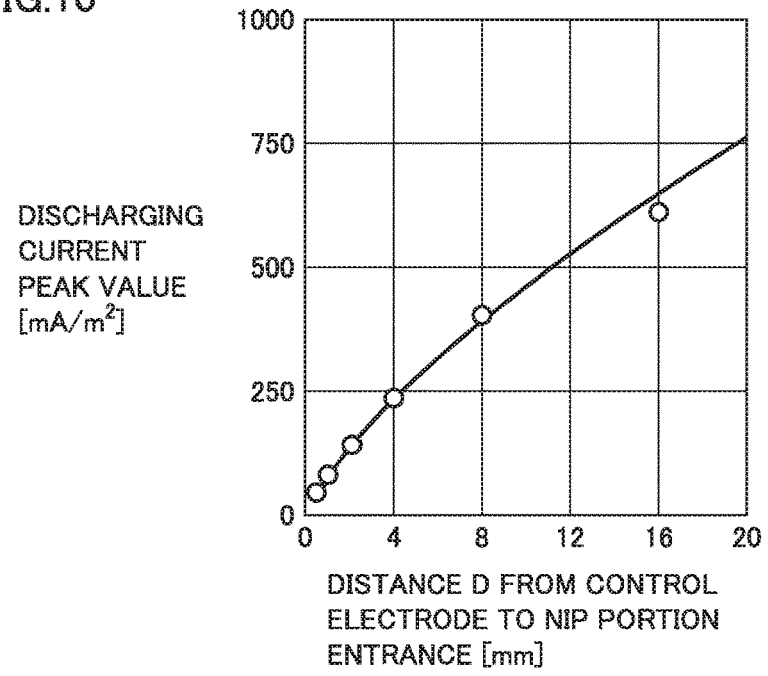

FIG.11

| | SET CONDITION | | | RESULT OF EVALUATION OF ACTUALLY FORMED IMAGE | | |
|---|---|---|---|---|---|---|
| | ELECTRODE | APPLIED VOLTAGE | CURRENT PEAK VALUE | TRANSFERABILITY | IMAGE DEFECT | TOTAL |
| COMPARATIVE EXAMPLE 1 | YES | 1000 | 0 | NOT GOOD | GOOD | NOT GOOD |
| EXAMPLE 1 | | 1400 | 50 | SATISFACTORY | GOOD | GOOD |
| EXAMPLE 2 | | 2300 | 294 | GOOD | GOOD | GOOD |
| EXAMPLE 3 | | 2900 | 450 | GOOD | SATISFACTORY | GOOD |
| COMPARATIVE EXAMPLE 2 | | 3200 | 510 | GOOD | NOT GOOD | NOT GOOD |
| COMPARATIVE EXAMPLE 3 | NO | 1000 | 0 | NOT GOOD | GOOD | NOT GOOD |
| COMPARATIVE EXAMPLE 4 | | 1400 | 460 | GOOD | NOT GOOD | NOT GOOD |
| COMPARATIVE EXAMPLE 5 | | 1700 | 805 | GOOD | NOT GOOD | NOT GOOD |
| COMPARATIVE EXAMPLE 6 | | 2000 | 1150 | GOOD | NOT GOOD | NOT GOOD |
| COMPARATIVE EXAMPLE 7 | | 2300 | 1495 | GOOD | NOT GOOD | NOT GOOD |

| | ELECTRODE POSITION | PRE-NIP | CURRENT PEAK VALUE | DISCHARGING BEFORE NIP | TRANSFERABILITY | IMAGE DEFECT | TOTAL |
|---|---|---|---|---|---|---|---|
| COMPARATIVE EXAMPLE 8 | 0.4mm | NO | 45 | NO | NOT GOOD | GOOD | NOT GOOD |
| EXAMPLE 4 | 0.8mm | | 80 | YES | SATISFACTORY | GOOD | GOOD |
| EXAMPLE 2 | 3mm | | 294 | YES | GOOD | GOOD | GOOD |
| EXAMPLE 5 | 5mm | | 413 | YES | GOOD | SATISFACTORY | GOOD |
| COMPARATIVE EXAMPLE 9 | 7mm | | 492 | YES | GOOD | NOT GOOD | NOT GOOD |

| | ELECTRODE POSITION | PRE-NIP | CURRENT PEAK VALUE | DISCHARGING BEFORE NIP | TRANSFERABILITY | IMAGE DEFECT | TOTAL |
|---|---|---|---|---|---|---|---|
| COMPARATIVE EXAMPLE 10 | 0.3mm | YES | 48 | NO | NOT GOOD | GOOD | NOT GOOD |
| EXAMPLE 6 | 0.5mm | | 60 | YES | SATISFACTORY | GOOD | GOOD |
| EXAMPLE 7 | 2mm | | 100 | YES | GOOD | GOOD | GOOD |
| EXAMPLE 8 | 3mm | | 130 | YES | GOOD | GOOD | GOOD |
| EXAMPLE 9 | 16mm | | 430 | YES | GOOD | SATISFACTORY | GOOD |
| COMPARATIVE EXAMPLE 11 | 18mm | | 480 | YES | GOOD | NOT GOOD | NOT GOOD |

CONTROL ELECTRODE FOR IMAGE FORMATION APPARATUS

The entire disclosure of Japanese Patent Application No. 2018-090164 filed on May 8, 2018 is incorporated herein by reference in its entirety.

BACKGROUND

Technological Field

The present disclosure relates to an image formation apparatus.

Description of the Related Art

Japanese Laid-Open Patent Publication No. 2000-305:381 discloses a construction for a conventional image formation apparatus. The image formation apparatus includes an opposing roll which abuts on an inner surface of a rotationally driven intermediate transfer belt, and a transfer roll which faces the opposing roll and abuts on an outer surface of the intermediate transfer belt. Transfer electric field is produced between the transfer roll and the opposing roll. Electric field restriction means weakens transfer electric field in a portion in the vicinity of a portion of abutment between the transfer roll and the intermediate transfer belt and on an upstream side in a direction of rotation of the intermediate transfer belt.

SUMMARY

This publication describes that Paschen discharging does not occur because the electric field restriction means weakens electric field. The present inventors have found a problem of failure in securing charges necessary for transfer when occurrence of discharging is prevented in particular in a high-speed apparatus.

Therefore, the present disclosure provides an image formation apparatus capable of achieving both of prevention of an image defect due to discharging in a transfer portion and ensured transfer efficiency.

When discharging occurs in a secondary transfer portion, such an image defect (what is called a white spot) that a part of a toner image to be transferred to a recording material is not transferred to form a white dot may occur. The present inventors have newly found that discharging upstream from a nip portion where a toner image is transferred to a recording material causes an image defect when a high discharging current flows, whereas it serves to supply charges necessary for transfer to a toner layer when a low discharging current which does not lead to an image defect flows. The present inventors have furthered their studies, found that means for supplying charges necessary for transfer while suppressing a high discharging current is required for achieving both of prevention of an image defect and ensured transfer efficiency, and invented a construction below.

An image formation apparatus according to the present disclosure comprises a transfer belt which carries a toner image, a transfer rotating body including an outer circumferential surface, the transfer rotating body transferring the toner image to a recording medium transported as being in contact with the outer circumferential surface and the transfer belt, and a control electrode in contact with the outer circumferential surface on an upstream side of a position of contact between the transfer rotating body and the recording medium in a direction of rotation of the transfer rotating body. The control electrode has a potential set to repel the toner image with respect to the transfer rotating body. The control electrode is in contact with the outer circumferential surface under such a condition that discharging occurs in a gap between the transfer rotating body and the transfer belt and a discharging current flows through the recording medium.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 10 shows a graph showing relation between a discharging current and a control electrode position.

FIG. 11 shows a table showing a result of evaluation of transferability and an image defect in a first Example.

DETAILED DESCRIPTION OF EMBODIMENTS

Figure 1:
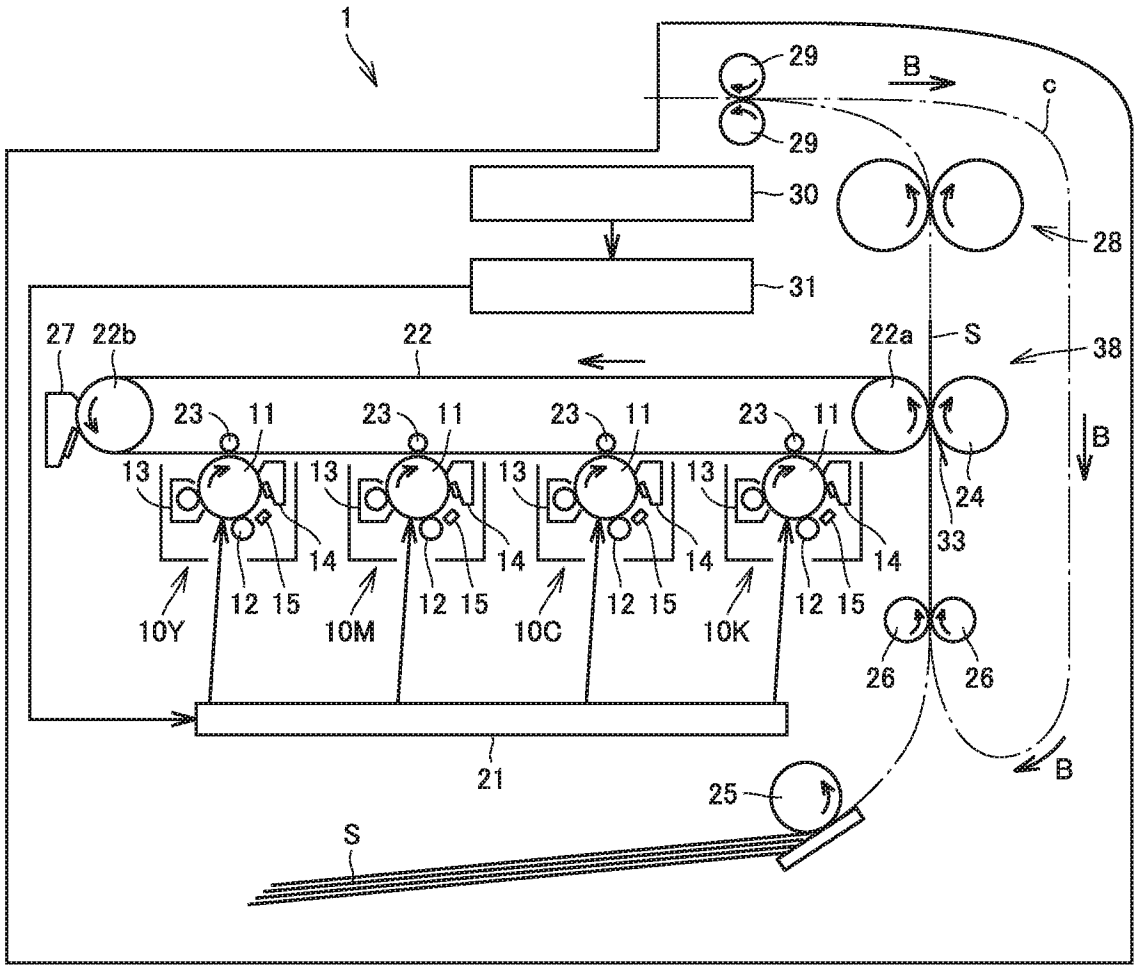
FIG. 1 is a schematic diagram showing an image formation apparatus according to an embodiment.

Hereinafter, one or more embodiments of the present invention will be described with reference to the drawings. However, the scope of the invention is not limited to the disclosed embodiments.

The same or substantially the same features in the embodiment shown below have the same reference characters allotted and redundant description will not be repeated.

(Image Formation Apparatus 1)

A direct transfer scheme and an intermediate transfer scheme are available as an image formation method. Under the direct transfer scheme, an image is formed by performing steps of directly transferring a toner image formed on a photoconductor to a recording medium and fixing by treating the toner image transferred onto the recording medium.

Under the intermediate transfer scheme, an image is formed by performing steps of transferring a toner image formed on a photoconductor to an intermediate transfer belt (primary transfer), transferring the toner image transferred onto the intermediate transfer belt to a recording medium (secondary transfer), and rising by heating the toner image transferred onto the recording medium.

FIG. 1 is a schematic diagram of an image formation apparatus 1 according to an embodiment. Image formation apparatus 1 which adopts the intermediate transfer scheme will be described with reference to FIG. 1.

Image formation apparatus 1 includes a latent image formation apparatus 21, an image information input portion 30, and an image information processing portion 31. Image information is input to image information input portion 30, for example, as a signal from an image scanner (not shown) included in image formation apparatus 1 and a personal computer.

Image information processing portion 31 processes image information obtained by image information input portion 30 and transmits the processed image information to latent image formation apparatus 21.

Image formation apparatus 1 further includes image formation units 10Y, 10M, 10C, and 10K. Image information units 10Y, 10M, 10C, and 10K form respective toner images of yellow (Y), magenta (M), cyan (C), and black (K).

Each of image formation units 10Y, 10M, 10C, and 10K includes a photoconductor 11 which carries a toner image, a charging apparatus 12 which charges a surface of photoconductor 11, and a development apparatus 13.

Each photoconductor 11 is exposed to light by latent image formation apparatus 21 based on image information transmitted front image information processing portion 31. An electrostatic latent image in accordance with the image information is formed on a surface of each photoconductor 11.

Each development apparatus 13 supplies toner of each color to the electrostatic latent image formed on the surface of each photoconductor 11. Each development apparatus 13 forms a toner image of each color on the surface of each photoconductor 11.

Image formation apparatus 1 further includes a drive roller 22*a*, a driven roller 22*b*, an intermediate transfer belt 22, and a primary transfer roller 23. Intermediate transfer belt 22 is supported under tension by drive roller 22*a* and driven roller 22*b*. Drive roller 22*a* is driven to rotate by a not-shown drive source such as a motor. Intermediate transfer belt 22 and driven roller 22*b* are rotated as following rotation of drive roller 22*a*.

The toner image of each color formed on the surface of each photoconductor 11 is transferred onto intermediate transfer belt 22 by each primary transfer roller 23 arranged as being opposed to each photoconductor 11. The loner image of each color is superimposed on intermediate transfer bell 22. Intermediate transfer belt 22 carries the toner images.

Each of image formation units 10Y, 10M, 10C, and 10K further includes a cleaning apparatus 14 and an erasure apparatus 15. Cleaning apparatus 14 removes residual toner on photoconductor 11 after the toner image formed on the suffice of photoconductor 11 is transferred to intermediate transfer belt 22. After cleaning apparatus 14 removes residual toner, erasure apparatus 15 removes electricity at the surface of each photoconductor 11.

Image formation apparatus 1 further includes a secondary transfer portion 38. The toner image transferred to intermediate transfer belt 22 by each primary transfer roller 23 is transported to secondary transfer portion 38. Secondary transfer portion 38 includes a secondary transfer roller 24. Secondary transfer roller 24 is arranged as being opposed to drive roller 22*a* with intermediate transfer belt 22 being interposed.

Image formation apparatus 1 accommodates recording medium S. Recording medium S is fed one by one by a paper feed roller 25 and transported to secondary transfer portion 38 by a timing roller 26. Timing roller 26 adjusts timing of transportation of recording medium S to secondary transfer portion 38 such that recording medium S is transported to secondary transfer portion 38 simultaneously with transportation of the toner image transferred onto intermediate transfer belt 22 to secondary transfer portion 38.

In secondary transfer portion 38, recording medium S is transported as being in contact with secondary transfer roller 24 and intermediate transfer belt 22. Secondary transfer roller 24 applies a transfer voltage opposite in polarity to the toner image on intermediate transfer belt 22 to recording medium S that is being transported. The toner image is thus attracted from intermediate transfer belt 22 toward secondary transfer roller 24 and transferred onto recording medium S.

Image formation apparatus 1 further includes a cleaner 27. Cleaner 27 removes from intermediate transfer belt 22, toner which remains on intermediate transfer belt 22 without being transferred to recording medium S in secondary transfer portion 38.

Recording medium S to which the toner image has been transferred in secondary transfer portion 38 is transported to a fixation apparatus 28. Fixation apparatus 28 fixes the toner image to recording medium S by pressurizing and heating recording medium S to which the toner image has been transferred. In single-sided printing, a toner image is fixed to recording medium S by fixation apparatus 28 and recording medium S is ejected to the outside of image formation apparatus 1 via a paper ejection roller 29.

In double-sided printing, recording medium S having a toner image fixed to its one surface (a first surface) is transported from paper ejection roller 29 through a reverse transportation path c along a direction shown with an arrow B. Recording medium S is again transported to secondary transfer portion 38 via timing roller 26. In secondary transfer portion 38, a toner image transferred onto intermediate transfer belt 22 is transferred to the other surface (a second surface) of recording medium S.

After the toner image is transferred to the second surface of recording medium S, recording medium S is transported to fixation apparatus 28. Fixation apparatus 28 fixes the toner image to the second surface of recording medium S. After the toner image is fixed to the second surface of recording medium S, recording medium S is ejected to the outside of image formation apparatus 1 via paper ejection roller 29.

(Secondary Transfer Portion 38)

Figure 2:
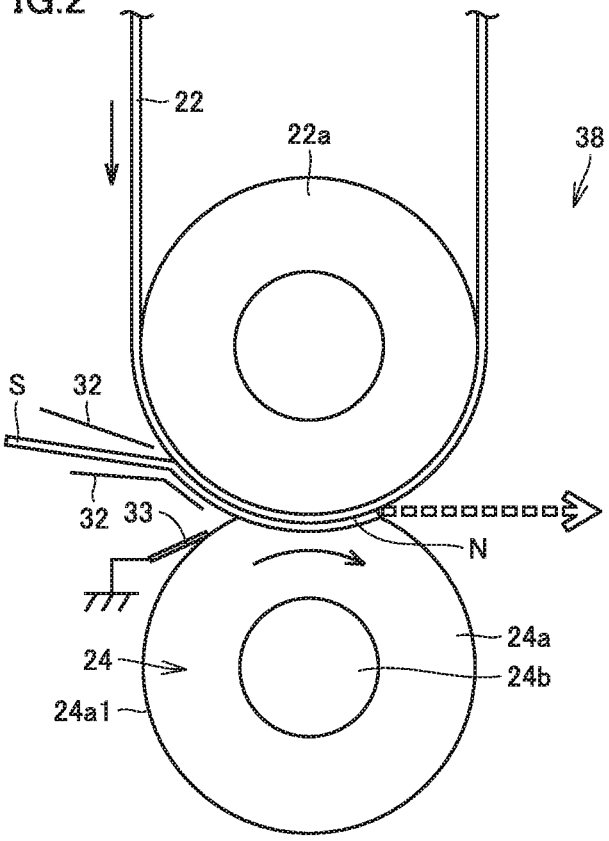
FIG. 2 is an enlarged view of a secondary transfer portion shown in FIG. 1.

FIG. 2 is an enlarged view of secondary transfer portion 38 shown in FIG. 1. As shown in FIGS. 1 and 2, intermediate transfer belt 22 is arranged to pass through secondary transfer portion 38 of formation apparatus 1. A solid straight arrow shown in FIG. 2 indicates a direction of movement of intermediate transfer belt 22.

Secondary transfer portion 38 includes secondary transfer roller 24 and drive roller 22*a* arranged as being in parallel and opposed to each other. A solid curved arrow shown in FIG. 2 indicates a direction of rotation of secondary transfer roller 24. A nip portion N is formed between secondary transfer roller 24 and drive roller 22*a*. Intermediate transfer belt 22 is arranged to pass through nip portion N and recording medium S is also transported to similarly pass through nip portion N.

Secondary transfer roller 24 includes a columnar core 24*b* and a cylindrical foamed elastic layer 24*a* which covers an outer circumferential surface of core 24*b*. Core 24*b* is made, for example, of a conductive material such as stainless steel. Core 24*b* has an outer diameter, for example, of 8 mm. Secondary transfer roller 24 may include a solid elastic layer instead of foamed elastic layer 24*a*. Alternatively, the construction may be such that a foamed elastic layer is provided in drive roller 22*a* and secondary transfer roller 24 is provided as a rigid roller.

Foamed elastic layer 24*a* is formed like a semiconductive foamed sponge by foaming a product in which a conductive filler such as carbon is dispersed in a rubber material (for example, polyurethane, ethylene propylene diene rubber (EPDM), and silicone) or a product in which an ionic conductive material is contained in the rubber material. A volume resistivity of foamed elastic layer 24*a* is adjusted, for example, approximately to $1\times10^5$ to $1\times10^9$ Ω·cm. Foamed elastic layer 24*a* has a thickness in a radial direction, for example, of 5 mm. Foamed elastic layer 24*a* has a surface hardness, for example, approximately from 20 to 70° (Asker–C).

Foamed elastic layer 24*a* includes an outer circumferential surface 24*a*1. Outer circumferential surface 24*a*1 defines an outer circumferential surface of secondary transfer roller 24. Therefore, outer circumferential surface 24*a*1 is also referred to as outer circumferential surface 24*a*1 of secondary transfer roller 24.

Intermediate transfer belt 22 is arranged to move past a side of drive roller 22*a* relative to recording medium S and recording medium S is transported to pass between intermediate transfer belt 22 and secondary transfer roller 24. A dashed arrow shown in FIG. 2 indicates a direction of transportation of recording medium S. A pair of guides 32 is arranged upstream from nip portion N in the direction of transportation of recording medium S. Recording medium S is introduced into nip portion N as being guided along the surface of intermediate transfer belt 22 by guide 32.

By guiding recording medium S and intermediate transfer belt 22 to nip portion N as being in contact with each other, a gap between recording medium S and intermediate transfer belt 22 at an entrance of nip portion N can be suppressed and an image defect due to discharging in the gap or displacement of a toner image at the entrance of nip portion N can be suppressed.

In nip portion N, recording medium S is in contact with intermediate transfer belt 22 and with outer circumferential surface 24*a*1 of secondary transfer roller 24. In nip portion N, a recording surface of recording medium S is arranged as facing intermediate transfer belt 22. While recording medium S is not being transported to nip portion N, outer circumferential surface 24*a*1 of secondary transfer roller 24 is contact with intermediate transfer belt 22.

Figure 3:
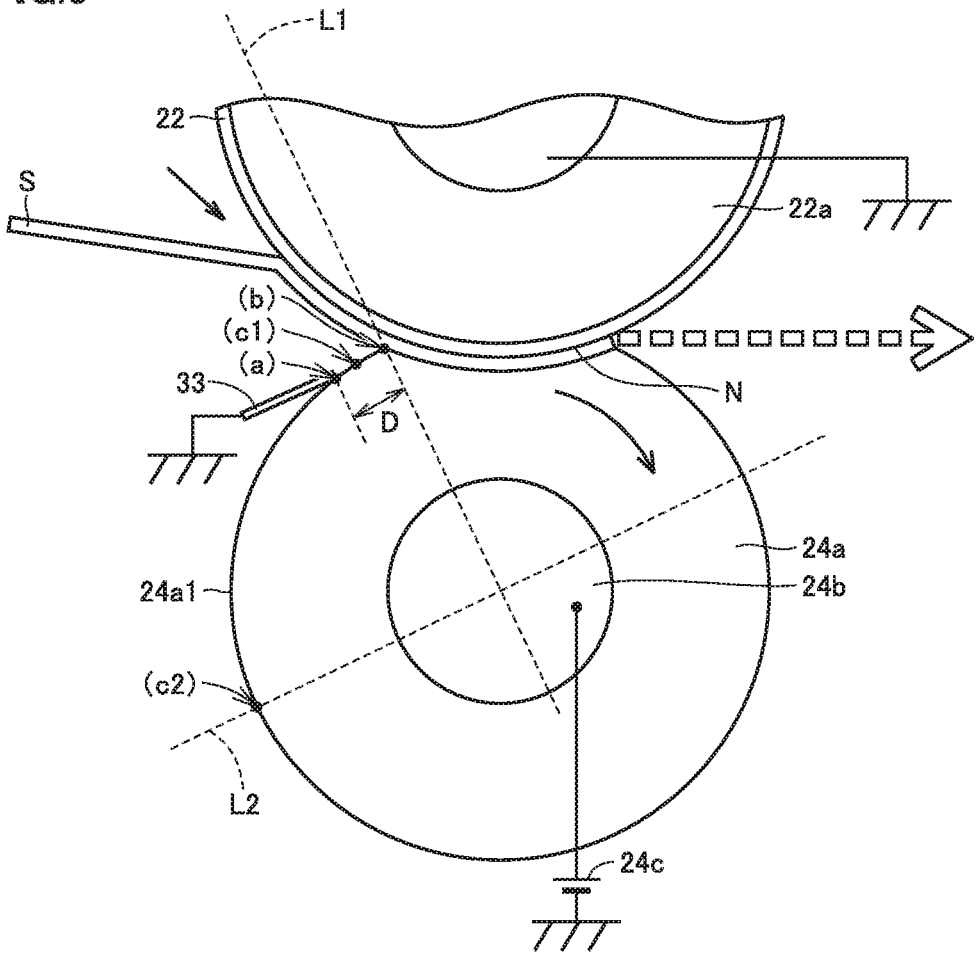
FIG. 3 is a schematic diagram showing a portion around a nip portion as being enlarged.

FIG. 3 is a schematic diagram showing a portion around nip portion N as being enlarged. As shown in FIG. 3, a secondary transfer voltage source 24*c* is connected to core 24*b* of secondary transfer roller 24. Drive roller 22*a* is grounded. Prescribed secondary transfer electric field is formed in nip portion N by secondary transfer roller 24, drive roller 22*a*, and secondary transfer voltage source 24*c*.

In transfer of a toner image, secondary transfer roller 24 is brought in press contact with drive roller 22*a* by not-shown press contact means with intermediate transfer belt 22 being interposed. Intermediate transfer belt 22 and recording medium S are thus brought in intimate contact with each other as being pressurized and sandwiched by secondary transfer roller 24 and drive roller 22*a*. At this time, secondary transfer electric field described above is applied to intermediate transfer belt 22 and recording Medium S in an intimate contact state. The toner image formed on intermediate transfer belt 22 thus adheres to recording medium S and the toner image is transferred.

Secondary transfer roller 24 has a function as the transfer rotating body in the embodiment which transfers a toner image to recording medium S transported as being in contact with outer circumferential surface 24*a*1 and intermediate transfer belt 22. Drive roller 22*a* has a function as the opposing rotating body in the embodiment which forms, as being opposed to secondary transfer roller 24, nip portion N together with secondary transfer roller 24.

(Construction of Control Electrode 33)

As shown in FIGS. 2 and 3, secondary transfer portion 38 further includes a control electrode 33. Control electrode 33 is in contact with outer circumferential surface 24*a*1 of secondary transfer roller 24. Control electrode 33 is arranged upstream from nip portion N in the direction of rotation of secondary transfer roller 24. Control electrode 33 is in contact with outer circumferential surface 24*a*1 of secondary transfer roller 24 on the upstream side of a position of contact of recording medium S with secondary transfer roller 24 in the direction of rotation of secondary transfer roller 24. Control electrode 33 has a potential set to repel a toner image with respect to core 24*b* of secondary transfer roller 24. In the embodiment, control electrode 33 is grounded.

A control electrode position (a) shown in FIG. 3 indicates a position where a tip end of control electrode 33 is in contact with outer circumferential surface 24*a*1 of secondary transfer roller 24. A contact position (b) indicates a position where transported recording medium S starts to come in contact with cuter circumferential surface 24*a*1 of secondary transfer roller 24. Secondary transfer roller 24 and recording medium S are in contact with each other at the contact position (b), and a distance between secondary transfer roller 24 and the recording medium is zero at the contact position (b). In the embodiment shown in FIG. 3, the contact position (b) corresponds to a most upstream position in nip portion N where secondary transfer roller 24 and drive roller 22*a* are in contact with each other with intermediate transfer belt 22 being interposed, that is, a nip entrance.

A first limit position (c1) indicates a position where discharging starts to occur between secondary transfer roller 24 and intermediate transfer belt 22. The first limit position (c1) is located on outer circumferential surface 24*a*1 of secondary transfer roller 24 and a distance between the first limit position (c1) and intermediate transfer belt 22 is equal to a threshold value beyond which discharging occurs in a gap between secondary transfer roller 24 and intermediate transfer belt 22. A position where discharging starts to occur between secondary transfer roller 24 and intermediate transfer belt 22 can be calculated in accordance with the well-known Paschen's Law, based on a voltage of secondary transfer voltage source 24*c* applied to core 24*b* of secondary transfer roller 24 and a width of a gap between outer circumferential surface 24*a*1 of secondary transfer roller 24 and intermediate transfer belt 22. At which position on outer circumferential surface 24*a*1 the first limit position (c1) is to be defined can be determined based on this result of calculation.

A straight line L1 represents a straight line which passes through the contact position (b) and the center of rotation of secondary transfer roller 24. A straight line L2 represents a straight line which passes through the center of rotation of secondary transfer roller 24 and is orthogonal to straight line L1. A second limit position (c2) indicates a position of intersection of straight line L2 with outer circumferential surface 24*a*1 of secondary transfer roller 24 on the upstream side of the contact position (b) in the direction of rotation of secondary transfer roller 24 (a direction shown with the solid curved arrow in FIG. 3). A distance D represents a distance between the control electrode position (a) and the contact position (b).

(Function of Control Electrode 33)

The present inventors have found that an amount of a discharging current which flows through recording medium S can properly be controlled by causing appropriate discharging in a gap between secondary transfer roller 24 and intermediate transfer belt 22 by setting the control electrode position (a) at a proper position and hence setting which can achieve both of prevention of an image defect and ensured transferability can be made.

Figure 4:
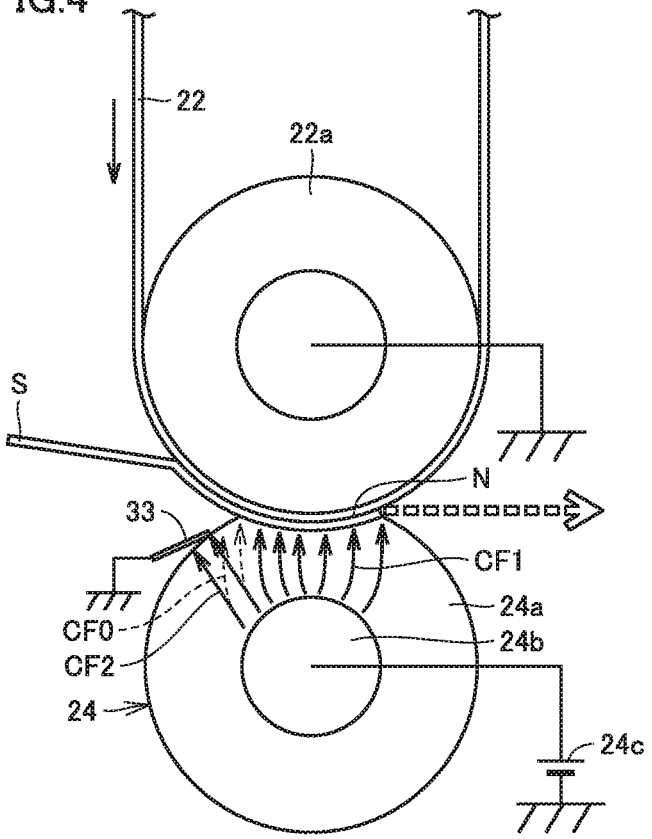
FIG. 4 is a schematic diagram showing a current in a secondary transfer roller according to the embodiment.

FIG. 4 is a schematic diagram showing a current in secondary ranger roller 24 according to the embodiment. When recording medium S enters nip portion N, a flow of a current from core 24*b* of secondary transfer roller 24 to drive roller 22*a* current flow CF1 shown with a solid arrow in FIG. 4) is generated. When a flow of a current from the upstream side in the direction of rotation into nip portion N along a circumferential direction of secondary transfer roller 24 (a current flow CF0 shown with a dashed arrow in FIG. 4) is generated, the current is concentrated at the entrance of nip portion N (the contact position (b)), and a substantial resistance value is lowered. In this case, a high current flows simultaneously with entry of recording medium S into nip portion N and large discharging is caused, which results in an image defect.

In the embodiment, control electrode 33 is arranged in the vicinity of nip portion N as being in contact with outer circumferential surface 24*a*1 of secondary transfer roller 24, so that a flow of a current from cote 24*b* toward control electrode 33 (a current flow CF2 shown with a solid arrow in FIG. 4) is generated to suppress the flow of the current from the upstream side in the direction of rotation of secondary transfer roller 24 into nip portion N (current flow CF0 shown with the dashed arrow in FIG. 4). Some of the current does not flow into nip portion N but flows to control electrode 33, so that concentration of the current to the entrance of nip portion N (the contact position (b)) can be suppressed. Consequently, lowering in substantial resistance value is lessened and a peak value of the current at the entrance of nip portion N (the contact position (b)) can be suppressed.

With increase in distance D between the control electrode position (a) and the contact position (b), an effect to lessen lowering in substantial resistance value becomes less. As distance D is greater, an effect of suppression of a peak value of the current at the entrance of nip portion N (the contact position (b)) becomes less. When the control electrode position (a) is more distant from the contact position (b) than from the second limit position (c2), that is, from a position distant by 90° from the contact position (b) on the upstream side in the direction of rotation of secondary transfer roller 24, an effect of control electrode 33 is not obtained. Therefore, the control electrode position (a) where control electrode 33 is in contact with outer circumferential surface 24*a*1 of secondary transfer roller 24 is set to be closer to the contact position (b) than to the second limit position (c2).

As distance D is smaller, the effect of suppression of the peak value of the current at the entrance of nip portion N (the contact position (b)) is higher, however, another problem arises. In recording medium S high in resistance, charges necessary for transfer are supplied by a discharging current. In particular in an example of high-speed image formation apparatus 1, charges are insufficient by supply of charges only in nip portion N and hence charges should be supplied by the discharging current by causing discharging upstream from nip portion N.

When control electrode 33 is interposed between secondary transfer roller 24 and intermediate transfer belt 22, discharging that occurs between secondary transfer roller 24 and intermediate transfer belt 22 is physically interfered by control electrode 33. When control electrode 33 is arranged closer to the contact position (b) than to the first limit position (c1), no potential difference is produced between secondary transfer roller 24 and intermediate transfer belt 22 on the upstream side of the control electrode position (a) in the direction of rotation of secondary transfer roller 24. Then, discharging does not occur. When distance D is too small, control electrode 33 interferes discharging. Then, charges necessary for transfer in secondary transfer portion 38 cannot be secured and image density is lowered.

Therefore, in order to ensure transfer efficiency by securing a gap where discharging is to occur between secondary transfer roller 24 and intermediate transfer belt 22, the control electrode position (a) where control electrode 33 is in contact with outer circumferential surface 24*a*1 of secondary transfer roller 24 is desirably set at a position more distant from the contact position (b) than from the first limit position (c1).

Control electrode 33 is not arranged within an area where a distance between secondary transfer roller 24 and intermediate transfer belt 22 is smaller than a width of a gap where discharging occurs.

(Method of Measuring Discharging Current in Secondary Transfer Portion 38)

Figure 5:
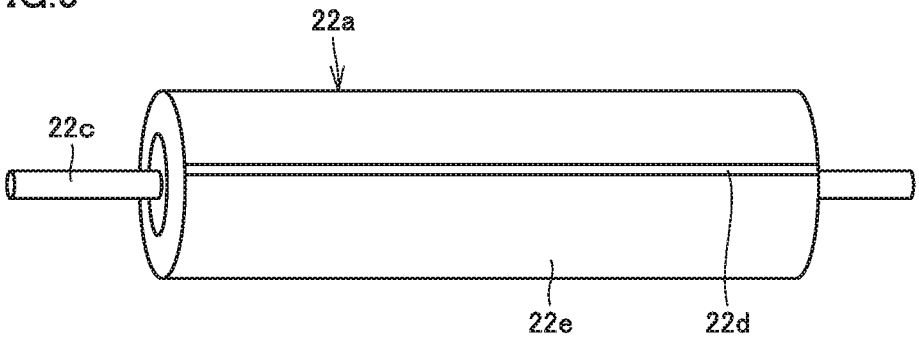
FIG. 5 is a perspective view of a drive roller for measuring a current.

A method of measuring a discharging current in the embodiment will be described below. FIG. 5 is a perspective view of drive roller 22*a* for measuring a current. Drive roller 22*a* shown in FIG. 5 is constructed to measure a current at the time of secondary transfer with a conductive core 22*c* being interposed, by winding a film 22*e* around an outer circumferential surface with a gap 22*d* being left in a part in the direction of rotation. Gap 22*d* has a width of 0.5 mm in the direction of rotation of drive roller 22*a*. A film composed of polyethylene terephthalate (PET) and having a thickness of 12 μm is employed as film 22*e*.

Drive roller 22*a* for measuring a current shown in FIG. 5 is attached to an image formation apparatus (a digital printer: bizhub PRESS C358) manufactured by Konica Minolta, Inc. and a current at the time of secondary transfer to recording medium S is measured under a condition of a linear velocity (a system speed) of the outer circumferential surface of drive roller 22*a* of 500 mm/s. Plain paper under the trademark J-Paper manufactured by Konica Minolta, Inc. is employed as recording medium S. A temperature and a humidity in a room at the time of image formation are set to 10° C. and 10%, respectively.

Figure 6:
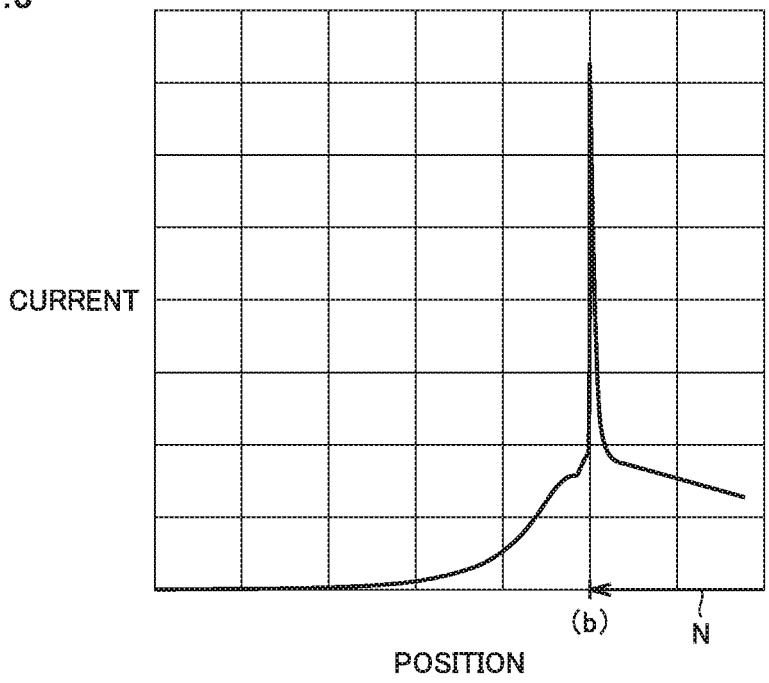
FIG. 6 shows a graph showing a value of a current measured in an image formation apparatus to which the drive roller shown in FIG. 5 is attached.

FIG. 6 shows a graph showing a value of a current measured in image formation apparatus 1 to which drive roller 22*a* shown in FIG. 5 is attached. The abscissa in FIG.

6 represents a position on the outer circumferential surface of drive roller 22*a*. A contact position (b) and a range of nip portion N are shown on the abscissa. The ordinate in FIG. 6 represents a value of a current measured at conductive core 22*c*. It is confirmed in FIG. 6 that a current flow is observed from a portion upstream from the entrance of nip portion N (the contact position (b)) and a high current peak appears at the entrance of nip portion N (the contact position (b)).

Figure 7:
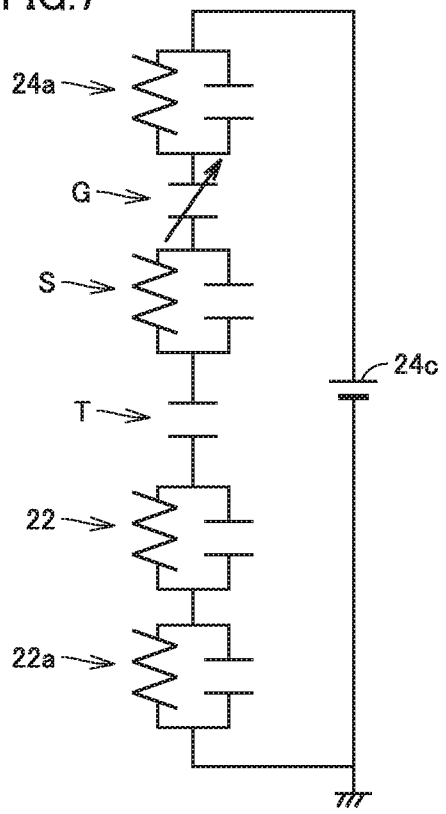
FIG. 7 is a diagram showing an equivalent circuit of the secondary transfer portion.

Then, a discharging current is roughly calculated. FIG. 7 is a diagram showing an equivalent circuit of secondary transfer portion 38. As shown in FIG. 7, secondary transfer portion 38 can be regarded as a circuit formed by secondary transfer roller 24, a gap G between secondary transfer roller 24 and intermediate transfer belt 22, recording median S, a toner layer T, intermediate transfer belt 22, and drive roller 22*a* connected in series to which a voltage of secondary transfer voltage source 24*c* is applied.

Figure 8:
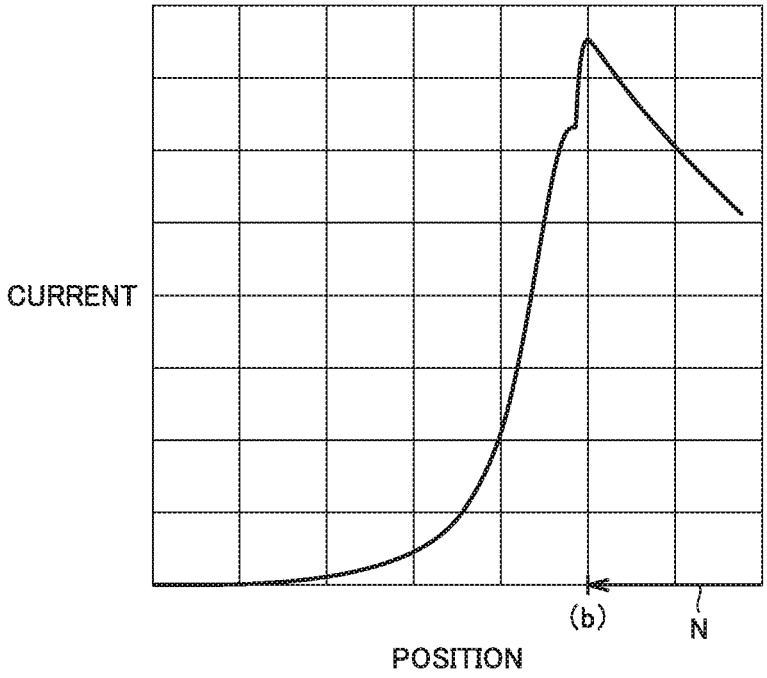
FIG. 8 shows a graph showing a value of a current which flows through the secondary transfer roller and the drive roller calculated based on the equivalent circuit shown in FIG. 7.

FIG. 8 shows a graph showing a value of a current which flows through secondary transfer roller 24 and drive roller 22*a* calculated based on the equivalent circuit shown in FIG. 7. The abscissa in FIG. 8 represents a position on the outer circumferential surface of drive roller 22*a*. A contact position (b) and a range of nip portion N are shown on the abscissa. The ordinate in FIG. 8 represents a current value calculated based on the equivalent circuit. A current which flows through secondary transfer roller 24 and drive roller 22*a* can be calculated as in FIG. 8 based on an electrical resistance and a capacitance of each member of secondary transfer roller 24, intermediate transfer belt 22, and drive roller 22*a* as well as recording medium S, a capacitance of toner layer T, and a shape of gap G upstream from nip portion N.

Figure 9:
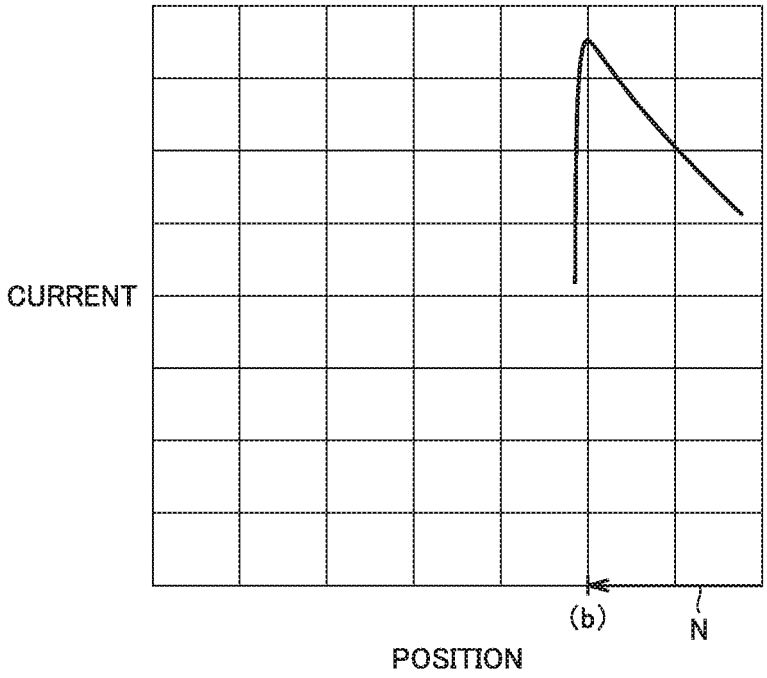
FIG. 9 shows a graph showing a value of a discharging current which flows through the secondary transfer roller and the drive roller calculated based on the equivalent circuit shown in FIG. 7.

FIG. 9 shows a graph showing a value of a discharging current which flows through secondary transfer roller 24 and drive roller 22*a* calculated based on the equivalent circuit shown in FIG. 7. In gap G upstream from nip portion N and an air layer in recording medium S, discharging occurs due to a potential difference not lower than a discharging start voltage. When an applied voltage exceeds the discharging start voltage, a discharging current is generated. The discharging start voltage is determined by a thickness of the air layer and a potential difference under the Paschen's Law. Charges not lower than the discharging start voltage are supplied to toner layer T as the discharging current.

In particular when recording medium S in which production of a white spot is likely has a high electrical resistance, recording medium S behaves as a capacitive component and the discharging current can be calculated as in FIG. 9. It can be seen based on comparison between FIGS. 8 and 9 that the discharging current in an area from the entrance of nip portion N to nip portion N accounts for most of the current that flows.

It can be concluded from calculation based on the circuit above that the discharging current in the area from the entrance of nip portion N to nip portion N accounts for most of a transfer current shown in FIG. 6 and hence a peak value of the current at the entrance of nip portion N is defined as a peak value of the discharging current.

(Relation Between Discharging Current and Control Electrode Position)

FIG. 10 shows a graph showing relation between a discharging current and a control electrode position (a). The abscissa in FIG. 10 represents distance D (unit: mm) between a control electrode position (a) and a contact position (b) and the ordinate represents a peak value (unit: $mA/m^2$) of a discharging current. FIG. 10 shows a result of examination of a peak value of a current when a plate made of SUS and having a thickness of 0.1 mm is set as control electrode 33 and brought in contact with outer circumferential surface 24*a*1 of secondary transfer roller 24 and a position at a tip end of control electrode 33 (that is, the control electrode position (a)) is varied.

It can be seen in FIG. 10 that, as distance D between the control electrode position (a) and the contact position (b) is smaller, lowering in substantial resistance value is less and hence an effect of lowering in current peak value is high.

EXAMPLES

First Example

In a first Example, an image formation apparatus (a digital printer: bizhub PRESS C358) manufactured by Konica Minolta, Inc. was employed and an image was actually formed with the control electrode being brought in contact with the outer circumferential surface of the secondary transfer roller equipped therein.

A roller including a core having a diameter of 20 mm and a foamed elastic layer having a diameter of 30 mm (made of nitrile butadiene rubber (NBR)) was employed as the secondary transfer roller and the drive roller of the image formation apparatus. In other words, the foamed elastic layer which covered the core had a thickness of 5 mm. A hardness of the foamed elastic layer measured with a micro durometer (MD-1 manufactured by Kobunshi Keiki Co., Ltd.) was 40°. The foamed elastic layer had an electrical resistance of approximately 10e8 Ω·cm. An axial length of a portion of pressure contact between the secondary transfer roller and the drive roller was set to 340 mm.

Positions of the rollers were adjusted such that the nip portion formed between the secondary transfer roller and the drive roller had a width of 3.5 mm and a peak pressure was set to 100 kPa.

A polyimide belt having an electrical resistance of approximately 10e8 Ω·cm and a thickness of 80 μm was employed as the intermediate transfer belt.

A plate material made of SUS and having a thickness of 0.1 mm was employed as the control electrode. The control electrode was grounded. A distance between a position of contact of the control electrode with the secondary transfer roller and a position of contact of the recording medium with the secondary transfer roller was set to a constant value of 3 mm.

Plain paper under the trademark of J-Paper manufactured by Konica Minolta, Inc. was employed as the recording medium. The recording medium had a thickness of 90 μm. An amount of toner to be transferred to the recording medium was set to 8 $g/m^2$. A speed of transportation (a system speed) of the recording medium during image formation was set to 500 mm/s. A solid image was formed.

A solid toner image was printed on opposing surfaces of the recording medium based on the conditions above with an applied voltage being varied, that is, with a current peak value being varied, and a current peak value at which ensured transferability and prevention of an image defect could both be achieved was examined.

In determining transferability, the toner image on the recording medium and residual toner on the intermediate transfer belt were peeled off by a transparent tape, reflection density was measured with a microdensitometer, and a transfer ratio was calculated based on the ratio of density. When the transfer ratio was not lower than 95%, determination as "good" was made, when the transfer ratio was not lower than 90% and lower than 95%, determination as "satisfactory" was made, and when the transfer ratio was lower than 90%, determination as "not good" was made.

In determining an image defect, a state of occurrence of an image defect in the toner image was visually observed. When no image defect (white spot) derived from discharging noise occurred, determination as "good" was made, when a slight image defect occurred, determination as "satisfactory" was made, and when an image defect occurred, determination as "not good" was made.

Figures 12, 13:
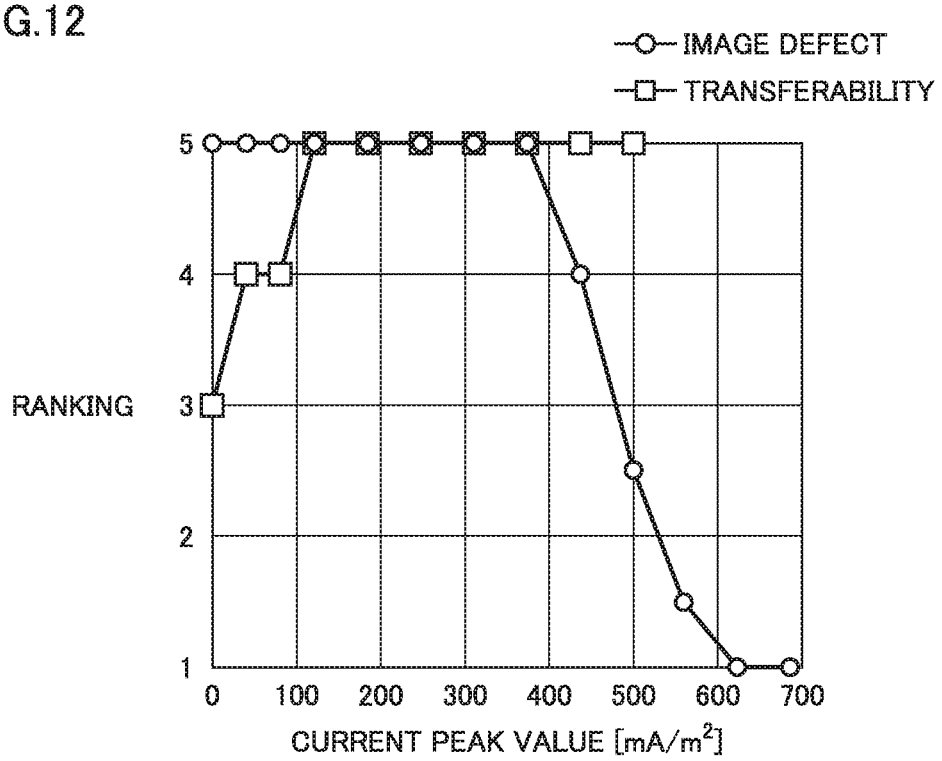
FIG. 12 shows a graph showing the result of evaluation shown in FIG. 11.
FIG. 13 shows a table showing a result of evaluation of transferability and an image defect in a second Example.

FIG. 11 shows a table showing a result of evaluation of transferability and an image defect in the first Example. FIG. 12 shows a graph showing the result of evaluation shown in FIG. 11. The abscissa shown in FIG. 12 represents a current peak value (unit: $mA/m^2$) and the ordinate represents ranking of results of evaluation. A rank 5 corresponds to "good", a rank 4 corresponds to "satisfactory", and a rank 3 or lower corresponds to "not good."

Examples 1 to 3 and Comparative Examples 1 to 2 show results of evaluation with the control electrode being brought into contact at a constant position with the secondary transfer roller and with a current peak value being varied. As shown in FIGS. 11 and 12, both of ensured transferability and ensured prevention of an image defect can be achieved within a range of current peak values not lower than 50 $mA/m^2$ and not higher than 450 $mA/m^2$.

Comparative Examples 3 to 7 show results of evaluation when no control electrode was provided. When no control electrode was provided, a condition under which both of ensured transferability and ensured prevention of an image defect could be achieved in a stable manner could not be found in spite of variation in current peak value.

Therefore, an image formation apparatus which can achieve both of ensured transferability and prevention of an image defect can be provided by bringing the control electrode into contact with the secondary transfer roller under such a condition that discharging occurs in a gap between the secondary transfer roller and the intermediate transfer belt to cause appropriate discharging in the gap and setting a maximum value of a density of a discharging current which flows through the recording medium to be not lower than 50 $mA/m^2$ and not higher than 450 $mA/m^2$.

Second Example

In a second example, an image formation apparatus the same as in the first Example was employed, a solid toner image was printed on opposing surfaces of a recording medium under conditions the same as in the first Example except that a constant voltage of 2300 V was applied and a control electrode position was varied, and a control electrode position at which ensured transferability and prevention of an image defect could both be achieved was examined.

FIG. 13 shows a table showing a result of evaluation of transferability and an image defect in the second Example. As shown in FIG. 13, in Comparative Example 8 in which a distance between the control electrode position and the contact position was set to 0.4 mm, discharging was interfered by the control electrode and determination as "not good" was made in determination of transferability. In Comparative Example 9 in which a distance between the control electrode position and the contact position was set to 7 mm, the effect of lowering in current peak value by the control electrode was not sufficiently obtained and hence determination as "not good" was made in determination of an image defect. As shown in Examples 2, 4, and 5, both of ensured transferability and prevention of an image defect could be achieved under a condition of a distance between the control electrode position and the contact position not smaller than 0.8 mm and not greater than 5 mm.

Third Example

Figures 14, 15:
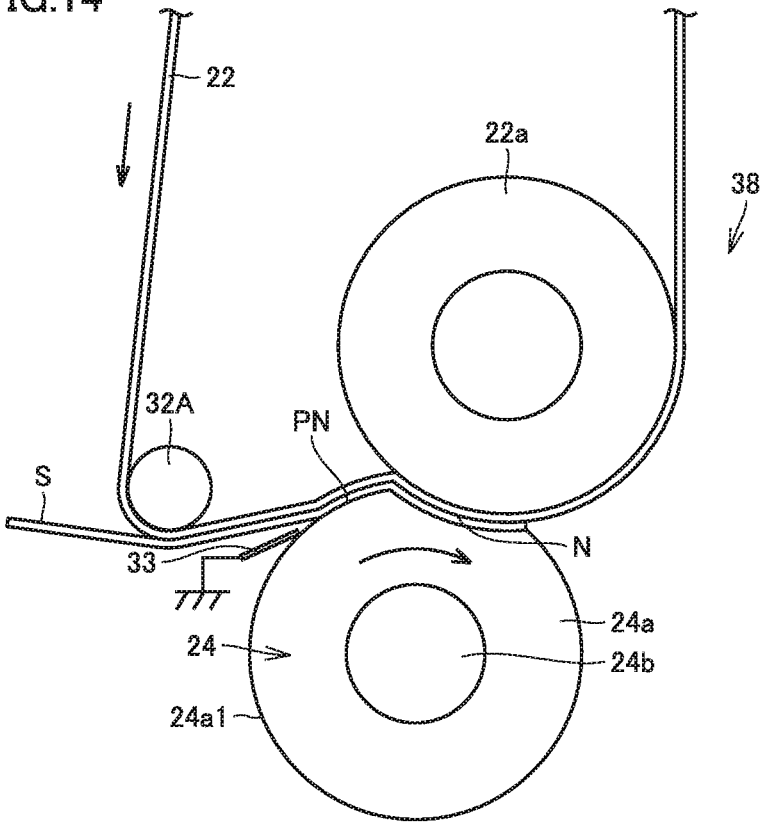
FIG. 14 is a schematic diagram of the secondary transfer portion in a third Example.
FIG. 15 shows a table showing a result of evaluation of transferability and an image defect in the third Example.

FIG. 14 is a schematic diagram of secondary transfer portion 38 in a third Example. Secondary transfer portion 38 shown in FIG. 14 includes What is called a pre-nip feature. Specifically, secondary transfer portion 38 further includes a guide member 32A. Guide member 32A is columnar. As shown in FIG. 14, guide member 32A defines a transportation path for recording medium S for bringing recording medium S into contact with outer circumferential surface 24*a*1 of secondary transfer roller 24 on the upstream side of nip portion N in the direction of transportation of recording medium S.

A pre-nip portion PN where recording medium S in contact with intermediate transfer belt 22 is in contact with outer circumferential surface 24*a*1 of secondary transfer roller 24 is formed upstream from nip portion N in the direction of transportation of recording medium S.

Control electrode 33 is in contact with outer circumferential surface 24*a*1 of secondary transfer roller 24 on the upstream side of pre-nip portion PN in the direction of rotation of secondary transfer roller 24. In the construction in which pre-nip portion PN shown in FIG. 14 is provided as well, control electrode 33 is in contact with outer circumferential surface 24*a*1 of secondary transfer roller 24 on the upstream side of the position of contact between secondary transfer roller 24 and recording medium S in the direction of rotation of secondary transfer roller 24.

FIG. 15 shows a table showing a result of evaluation of transferability and an image defect in the third Example. In the third Example, a control electrode position at which ensured transferability and prevention of an image defect could both be achieved under conditions the same as in the second Example was examined. As shown in Examples 6 to 9, both of ensured transferability and prevention of an image defect could be achieved under a condition of a distance between the control electrode position and the contact position not smaller than 0.5 mm and not greater than 16 mm.

It was shown based on comparison between FIGS. 13 and 15 that, by providing pre-nip portion PN, both of ensured transferability and prevention of an image defect could be achieved even when the control electrode is arranged in a wider area and a degree of freedom of the control electrode position could be improved.

Although embodiments of the present invention have been described and illustrated in detail, the disclosed embodiments are made for the purposes of illustration and example only and not limitation. The scope of the present invention should be interpreted by terms of the appended claims.

What is claimed is:

1. An image formation apparatus comprising:

a transfer belt which carries a toner image;

a transfer rotating body including an outer circumferential surface, the transfer rotating body transferring the toner image to a recording medium transported as being in contact with the outer circumferential surface and the transfer belt; and a control electrode in contact with the outer circumferential surface on an upstream side of a position of contact between the transfer rotating body and the recording medium in a direction of rotation of the transfer rotating body, the control electrode having a potential set to repel the toner image with respect to the transfer rotating body, the control electrode being in contact with the outer circumferential surface such that discharging occurs in a gap between the transfer rotating body and the transfer belt and a discharging current flows through the recording medium, wherein the outer circumferential surface has a first limit position at which a distance between the outer circumferential surface and the transfer belt is equal to a threshold value beyond which discharging occurs in the gap and a second limit position at which a straight line orthogonal to a straight line which passes through the position of contact and a center of rotation of the transfer rotating body intersects with the outer circumferential surface on the upstream side of the position of contact in the direction of rotation, and the control electrode is in contact with the outer circumferential surface at a position more distant from the position of contact than from the first limit position and closer to the position of contact than to the second limit position.

2. The image formation apparatus according to claim 1, wherein a maximum value of a density of the discharging current which flows through the recording medium is not less than 50 mA/m2 and not more than 450 mA/m2.

3. The image formation apparatus according to claim 1, the image formation apparatus further comprising:

an opposing rotating body which is opposed to the transfer rotating body and forms a nip portion together with the transfer rotating body; and a guide member which defines a transportation path for the recording medium for bringing the recording medium into contact with the outer circumferential surface on the upstream side of the nip portion in a direction of transportation of the recording medium.

* * * * *